US010999900B2

(12) United States Patent
Kitano et al.

(10) Patent No.: US 10,999,900 B2
(45) **Date of Patent: *May 4, 2021**

(54) INDUCTION HEATED ROLL APPARATUS

(71) Applicant: TOKUDEN CO., LTD., Kyoto (JP)

(72) Inventors: Yoshio Kitano, Kyoto (JP); Osamichi Matsukawa, Kyoto (JP); Toru Tonomura, Otsu (JP)

(73) Assignee: TOKUDEN CO., LTD., Kyoto (JP)

( * ) Notice: Subject to any disclaimer, the term of this patent is extended or adjusted under 35 U.S.C. 154(b) by 264 days.

This patent is subject to a terminal disclaimer.

(21) Appl. No.: 16/184,500

(22) Filed: Nov. 8, 2018

(65) Prior Publication Data

US 2019/0150232 A1 May 16, 2019

(30) Foreign Application Priority Data

Nov. 13, 2017 (JP) ..... JP2017-218451
Aug. 23, 2018 (JP) ..... JP2018-155995

(51) Int. Cl.
*H05B 6/14* (2006.01)
*H05B 6/44* (2006.01)

(52) U.S. Cl.
CPC ..... *H05B 6/145* (2013.01); *H05B 6/44* (2013.01)

(58) Field of Classification Search
CPC . H05B 6/145; H05B 6/06; H05B 6/44; H05B 6/36; B21B 27/106; G01B 21/10; G01N 27/02; G01K 13/00
USPC ..... 219/619, 469, 667, 665, 635, 645; 399/69, 328, 330, 331, 335, 336, 338, 399/329
See application file for complete search history.

(56) References Cited

U.S. PATENT DOCUMENTS

2003/0147679 A1 8/2003 Shimizu et al.
2012/0080423 A1 4/2012 Takeda
2013/0299219 A1* 11/2013 Chisaka ..... H05K 1/185 174/257

(Continued)

FOREIGN PATENT DOCUMENTS

DE 112010003915 T5 11/2012
JP S45029650 Y 11/1970

(Continued)

OTHER PUBLICATIONS

China National Intellectual Property Administration, Office Action and Search Report Issued in Application No. 201821830925.9, dated Aug. 15, 2019, 1 page.

(Continued)

*Primary Examiner* — Phuong T Nguyen
*Assistant Examiner* — Yeong Juen Thong
(74) *Attorney, Agent, or Firm* — Alleman Hall Creasman & Tuttle LLP

(57) ABSTRACT

The present invention is one that intends to reduce the number of working processes necessary to provide a secondary conductor on the inner circumferential surface of a roll main body, and an induction heated roll apparatus including: a roll main body that is rotatably supported; and an induction heating mechanism that is provided inside the roll main body and has an induction coil for allowing the roll main body to inductively generate heat. In addition, on the inner circumferential surface of the roll main body, the secondary conductor is formed by build-up welding.

4 Claims, 8 Drawing Sheets

(56) References Cited

U.S. PATENT DOCUMENTS

| | | | | |
|---|---|---|---|---|
| 2015/0230294 | A1 | 8/2015 | Tonomura et al. | |
| 2015/0368506 | A1* | 12/2015 | Niimoto ..... | C09D 5/08<br>428/418 |
| 2016/0212836 | A1 | 7/2016 | Arai et al. | |
| 2018/0037978 | A1 | 2/2018 | Murakami et al. | |
| 2019/0150231 | A1 | 5/2019 | Kitano et al. | |

FOREIGN PATENT DOCUMENTS

| | | | | |
|---|---|---|---|---|
| JP | 2016062681 | A | * | 4/2016 |
| JP | 2016062681 | A | | 4/2016 |

OTHER PUBLICATIONS

European Patent Office, Extended European Search Report Issued in Application No. 18205459.0, dated Apr. 2, 2019, Germany, 7 pages.
National Physical Laboratory "Guides to Good Practice in Corrosion Control" Published by National Physical Laboratory, Published in 2000, 20 pages.
European Patent Office, Extended European Search Report Issued in Application No. 18205493.2, dated Apr. 2, 2019, Germany, 6 pages.
Achitei, D. et al., "Study of Aluminum Bronze, Mark CuAl9Mn2" conference paper—May 2013 publication at https://www.researchgate.net/publication/269762113 p. 172-173 (Year:2013) 7 pages.
"Critical Melting Points and Reference Data for Vacuum Heat Treating" Published by Solar Atmospheres, 2011, 42 pages.

* cited by examiner

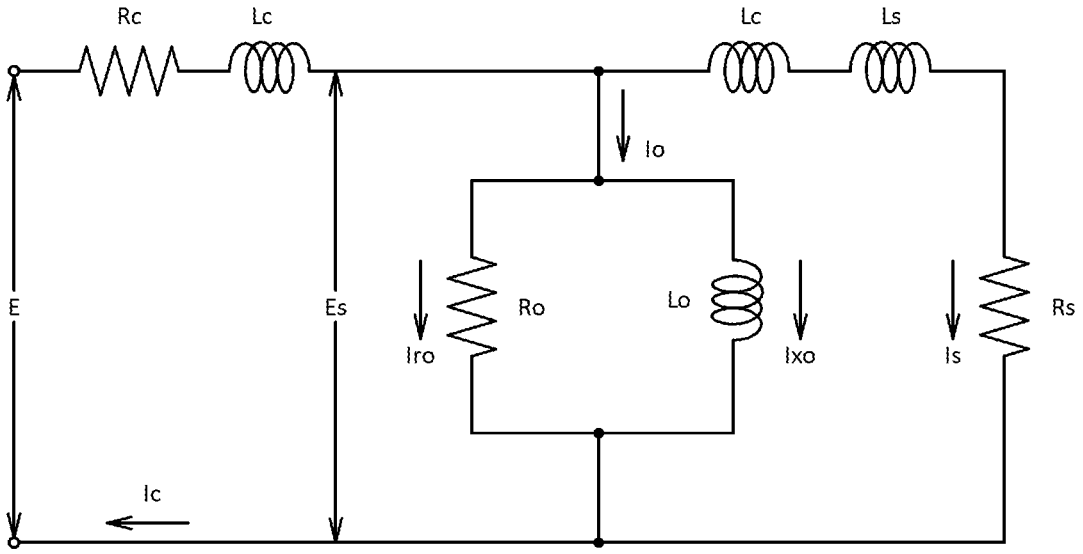

EQUIVALENT CIRCUIT OF INDUCTION HEATED ROLL APPARATUS

E: INPUT VOLTAGE
Es: INDUCED VOLTAGE
Rc: COIL RESISTANCE
Rs: RESISTANCE OF ROLL MAIN BODY
Ro: EXCITATION RESISTANCE
Lc: INDUCTANCE BETWEEN COIL AND ROLL MAIN BODY
Ls: LEAKAGE INDUCTANCE OF ROLL MAIN BODY
Lo: EXCITATION INDUCTANCE
Is: CURRENT OF ROLL MAIN BODY
Io: EXCITATION CURRENT
Iro: EXCITATION RESISTOR CURRENT
Ixo: EXCITATION COIL CURRENT
Ic: LOAD CURRENT

FIG. 4

INDUCTION HEATED ROLL APPARATUS

TECHNICAL FIELD

The present invention relates to an induction heated roll apparatus, and in particular, to a roll main body provided with a secondary conductor.

BACKGROUND ART

As an induction heated roll apparatus, there is one that includes: a roll main body made of a magnetic material; and an induction heating mechanism provided in the roll main body and having an induction coil, and allows the roll main body to inductively generate heat by applying alternating current (AC) voltage having a commercial frequency to the induction coil. In this induction heated roll apparatus, the roll main body constitutes both a magnetic circuit through which magnetic flux passes and a current circuit through which a short-circuit current flows due to electromagnetic induction. For this reason, an impedance that prevents the short-circuit current from easily flowing occurs in the roll main body and thereby a power factor is reduced.

As means adapted to prevent the reduction in power factor, as disclosed in Patent Literature 1, it is considered to provide a secondary conductor made of a non-magnetic material on the inner circumferential surface of a roll main body.

A conventional method for providing a secondary conductor on the inner circumferential surface of a roll main body is as follows.

First, a cylindrical tube body is formed by bending a copper plate and then joining by silver brazing or the like. The tube body is subjected to a plating process for rust prevention. Then, the tube body having been subjected to the plating process is brazed on the inner circumferential surface of the roll main body. In doing so, the secondary conductor is provided on the inner circumferential surface of the roll main body. In addition to the brazing, there is also a method that provides the secondary conductor by press-fitting or shrink-fitting the tube body into the roll main body.

However, the above method requires many working processes such as a process for fabricating the tube body from the copper plate, a process for performing a plating process for rust prevention on the tube body, and a process for fitting the tube body into the roll main body.

In addition, in the case of the brazing-based fitting method, it is difficult to perform brazing over the entire outer circumferential surface of the tube body, and therefore the method may be inappropriate for the roll main body rotating at high speed. Also, in the case of the fitting method such as press-fitting or shrink-fitting, the roll main body and the secondary conductor are only mechanically in close contact with each other, and since there is a difference in thermal expansion between the roll main body and the secondary conductor, a repetitive change in temperature of the roll main body and secondary conductor results in loosening. As a result, there is also the problem of a reduction in thermal conductivity between the roll main body and the secondary conductor.

CITATION LIST

Patent Literatures

Patent Literature 1: Japanese Examined Utility Model Application Publication No. 45-29650

SUMMARY OF INVENTION

Technical Problem

Therefore, the present invention has been made in order to solve the above-described problems, and a main object thereof is to reduce the number of working processes necessary to provide a secondary conductor on the inner circumferential surface of a roll main body.

Solution to Problem

That is, an induction heated roll apparatus according to the present invention is one including: a roll main body that is rotatably supported; and an induction heating mechanism that is provided inside the roll main body and has an induction coil for allowing the roll main body to inductively generate heat, and allowing the roll main body to inductively generate heat by applying alternating current (AC) voltage having a commercial frequency to the induction coil. In addition, on the inner circumferential surface of the roll main body, a secondary conductor is formed by build-up welding, the secondary conductor is made of aluminum bronze, and the surface of the secondary conductor is not subjected to a rust-proofing process.

In such a configuration, since the secondary conductor is formed by build-up welding, a tube body forming process and a tube body fitting process in the conventional case can be omitted. Also, a thin protective oxide coating film is formed on the surface of aluminum bronze, and therefore aluminum bronze is characterized by preventing oxidation at high temperatures and is consequently resistant to corrosion. Also, by using aluminum bronze for the secondary conductor, a rust-proofing process such as a plating process can be omitted. As a result, the number of working processes necessary to provide the secondary conductor on the inner circumferential surface of the roll main body can be reduced. Further, only build-up welding is required, and therefore work to fit the secondary conductor on the inner circumferential surface of the roll main body can be facilitated. Still further, since the secondary conductor is formed by build-up welding, the roll main body and the secondary conductor are integrated and therefore also applicable to high speed rotation, and there is no loosening due to the difference in thermal expansion coefficient between the roll main body and the secondary conductor, thus making it possible to also suppress a reduction in thermal conductivity between the roll main body and the secondary conductor.

Note that the electrical resistance value of aluminum bronze is approximately six times larger as compared with that of copper, and in order to obtain the same effects as copper, approximately a six-fold thickness is required. However, the current penetration depth of aluminum bronze in induction heating at a commercial frequency is as deep as approximately 22 mm (at 20° C. and 60 Hz) as a calculation value, and therefore a required thickness can be set to the current penetration depth or less. The required thickness refers to a thickness for obtaining a target power factor (e.g., 80% or more), and can be calculated using an equivalent electrical circuit diagram (see FIG. 4) in the induction heating at a commercial frequency.

In the case of aluminum bronze, as the aluminum content increases, the protective characteristics of the oxide increases; however, adding more than 6% of aluminum, results in little additional improvement in oxidation resistance (see FIG. 5). Accordingly, the aluminum bronze desirably contains 6% or more of aluminum.

The induction heated roll apparatus includes: a power supply part that supplies electric power to the inductive heating mechanism; and a temperature control part that controls the power supply part to control the temperature of the roll main body. In addition, the temperature control part controls the temperature of the roll main body to a predetermined value.

In the case of aluminum bronze containing 6% or more of aluminum, oxidation at 500° C. or less is extremely slight. However, at temperatures higher than 500° C., an increase in weight due to oxidation becomes problematic (See FIG. 6). For this reason, a settable temperature by the temperature control part is desirably 500° C. or less.

The build-up welded aluminum bronze has a slight unevenness in the thickness in a circumferential direction, in particular, in a width direction. However, by managing the weight of aluminum bronze to be welded, fabrication can be performed with an average thickness over the winding width of the induction coil as calculated. As a result, the fabrication becomes possible with an electrical capacity and power factor consistent with design values.

Also, as long as within the thickness of the roll main body, a jacket chamber in which a vapor-liquid two-phase heating medium is enclosed under reduced pressure is formed, even when uneven heat generation occurs due to the uneven thickness of aluminum copper, the surface temperature of the roll main body is equalized by the temperature equalizing action of the jacket chamber. For this reason, machining for equalizing the thickness of the secondary conductor is not necessary. That is, the need to perform a planarization process using removal machining on the surface of the secondary conductor is eliminated.

The jacket chamber within the thickness of the roll main body is formed by drilling a drillhole from an end surface of the roll main body along an axis direction to form the drillhole within the thickness of the roll main body, and closing the opening of the drillhole. Since the dimension of the roll main body in the axis direction is long, the drillhole does not go straight but curves. If the thickness of the roll main body is small, a drill may penetrate through the (outer) surface or inner circumferential surface of the roll main body, and the roll main body and the drillhole have to be remade. The surface of the roll main body may be subjected to a hardening process such as high frequency hardening in order to prolong its life, and in this case, the drillhole does not curve toward the surface but curves toward the inner circumferential surface.

Meanwhile, when the secondary conductor is build-up welded on the inner circumferential surface of the roll main body, the resulting structure includes weld metal, bond, a heat-affected zone, and a base material unaffected zone from the outside. The bond refers to the boundary between the weld metal and the base material, and a range of a few mm just on the base material side of the bond is referred to as the heat-affected zone. When an arc passes, the heat-affected zone having reached a high temperature due to welding heat rapidly decreases in temperature and is thereby rapidly cooled. Such heating and rapid cooling change the structure of the original base material, and consequently hardness becomes high. When aluminum bronze is build-up welded, the hardness of the inner circumferential surface of the roll main body becomes high, and therefore the drillhole is unlikely to curve toward the inner circumferential surface, thus making it possible to reduce the problem of the drillhole penetrating through the inner circumferential surface of the roll main body.

Magnetic flux generated by the induction coil during the induction heating concentrates on the center of the coil, and therefore the center of the roll main body in its axis direction tends to become high in temperature. On the other hand, a part where the secondary conductor is thickly build-up welded becomes low in resistance, and therefore large current flows to increase a calorific value. Accordingly, by thickly performing the build-up welding of the secondary conductor in parts corresponding to the end parts of the winding width of the induction coil, the calorific value of the roll main body can be equalized in its axis direction. Also, by adjusting the build-up thickness, the calorific value of the roll main body can be partially increased or decreased. For this purpose, it is desirable to change the thickness of the secondary conductor along the axis direction of the roll main body.

It is desirable that the secondary conductor is annularly formed at intervals on the inner circumferential surface of the roll main body. Forming the secondary conductor at intervals in this manner makes it possible to facilitate the working thereof.

In particular, in order to continuously work the secondary conductor while facilitating the working of the secondary conductor, it is desirable that the secondary conductor is spirally formed at intervals on the inner circumferential surface of the roll main body.

In order to equalize the electrical characteristics of respective induction heated roll apparatuses, it is desirable that the electrical characteristic of the induction heated roll apparatus is adjusted by the weight of the secondary conductor. For example, as long as the specifications of respective roll main bodies are the same, by equalizing the weights of secondary conductors to be worked, power factors and electrical capacities are also equalized, and work management is extremely easy.

Also, the induction heated roll apparatus according to the present invention is one including: a roll main body that is rotatably supported; and an induction heating mechanism that is provided inside the roll main body and has an induction coil for allowing the roll main body to inductively generate heat, and allowing the roll main body to inductively generate heat by applying alternating current (AC) voltage having a commercial frequency to the induction coil. In addition, on the inner circumferential surface of the roll main body, a secondary conductor is formed by build-up welding, the secondary conductor is made of white copper (cupronickel, an alloy of copper and nickel), German silver (nickel silver; an alloy of copper, zinc, and nickel), red copper (an alloy of copper and gold), gunmetal (an alloy of copper and tin), or a combination thereof, and the surface of the secondary conductor is not subjected to a rust-proofing process. White copper (cupronickel), German silver (nickel silver), red copper, and gunmetal are also non-magnetic copper alloys having high corrosion resistance. By using these for the secondary conductor as well, the same effects as the use of aluminum bronze can be obtained.

In the secondary conductor subjected to the build-up welding, unevenness in thickness may occur in the circumferential direction, in particular, in the width direction. The uneven thickness causes uneven heat generation. For this reason, in the past, in order to equalize the thickness of a secondary conductor, it has been necessary to perform machining (e.g., planarization process) on the surface of the secondary conductor. Also, in consideration of performing the planarization process on the secondary conductor, the secondary conductor has been formed to be thicker and removed by machining, and therefore excessive material has been required.

In order to preferably solve this problem, the induction heated roll apparatus according to the present invention is one including: a roll main body that is rotatably supported; and an induction heating mechanism that is provided inside the roll main body and has an induction coil for allowing the roll main body to inductively generate heat, and allowing the roll main body to inductively generate heat by applying AC voltage having a commercial frequency to the induction coil. In addition, within the thickness of the roll main body, a jacket chamber in which a vapor-liquid two-phase heating medium is enclosed under reduced pressure is formed, on the inner circumferential surface of the roll main body, a secondary conductor is formed by build-up welding, the secondary conductor is made of copper or copper alloy, and the surface of the secondary conductor is not subjected to a planarization process using removal machining.

In the present invention, the secondary conductor is formed by the build-up welding, and therefore the tube body forming process and the tube body attachment process in the conventional case can be omitted. As a result, the number of working processes necessary to provide the secondary conductor on the inner circumferential surface of the roll main body can be reduced. Also, only the build-up welding is required, and therefore work to fit the secondary conductor on the inner circumferential surface of the roll main body can be facilitated. Further, since the secondary conductor is formed by build-up welding, the roll main body and the secondary conductor are integrated and therefore also applicable to high speed rotation, and there is no loosening due to the difference in thermal expansion coefficient between the roll main body and the secondary conductor, thus making it possible to also suppress a reduction in thermal conductivity between the roll main body and the secondary conductor.

Copper or copper alloy subjected to build-up welding has a slight unevenness in thickness in the circumferential direction, in particular, in the width direction. However, as long as the weight of copper or copper alloy to be welded is managed, fabrication can be performed with an average thickness over the winding width of the induction coil as calculated. As a result, the fabrication becomes possible with electrical capacity and power factor coincident with design values.

Also, as long as within the thickness of the roll main body, the jacket chamber in which the vapor-liquid two-phase heating medium is enclosed under reduced pressure is formed, even when uneven heat generation occurs due to the uneven thickness of copper or copper alloy, the surface temperature of the roll main body is equalized by the temperature equalizing action of the jacket chamber. For this reason, machining for equalizing the thickness of the secondary conductor is not necessary. That is, the need to perform a planarization process using removal machining on the surface of the secondary conductor is eliminated. As a result, the number of working processes to be performed on the secondary conductor can be reduced, and also, since the secondary conductor is not removed, unnecessary material can be eliminated.

In order to further improve the power factor of the induction heated roll apparatus, it is desirable that the secondary conductor is one of a cylindrical shape that is continuously formed from a first end part to a second end part of the roll main body in an axis direction.

Copper is oxidized at high temperatures and transformed into oxide, and therefore the electrical characteristics thereof changes to change induction heating characteristics. Also, many types of copper alloys tend to be oxidized at high temperatures. For this reason, it is desirable that the surface of the secondary conductor is subjected to a rust-proofing process.

As the rust-proofing process, it is desirable to form a coating of metal or ceramic that is resistant to the temperature of the roll main body to be used and not easily oxidized at the temperature. For example, a nickel-plating coating is usable up to approximately 400° C., and an aluminum evaporation coating is usable up to approximately 500° C. because aluminum is transformed into alumite at high temperatures.

Advantageous Effects of Invention

According to the present invention configured as described above, the number of working processes necessary to provide a secondary conductor on the inner circumferential surface of a roll main body can be reduced.

BRIEF DESCRIPTION OF DRAWINGS

FIG. 4 is an equivalent electrical circuit diagram of the induction heated roll apparatus;

DESCRIPTION OF EMBODIMENTS

In the following, one embodiment of the induction heated roll apparatus according to the present invention will be described with reference to the drawings.

An induction heated roll apparatus 100 according to the present invention is one used in some processes such as a continuous heat treatment process for continuous materials such as a sheet material, web material, or wire (thread) material formed of, for example, plastic film, paper, cloth, nonwoven fabric, synthetic fiber, or metal foil.

1. Apparatus Configuration

Figure 1:
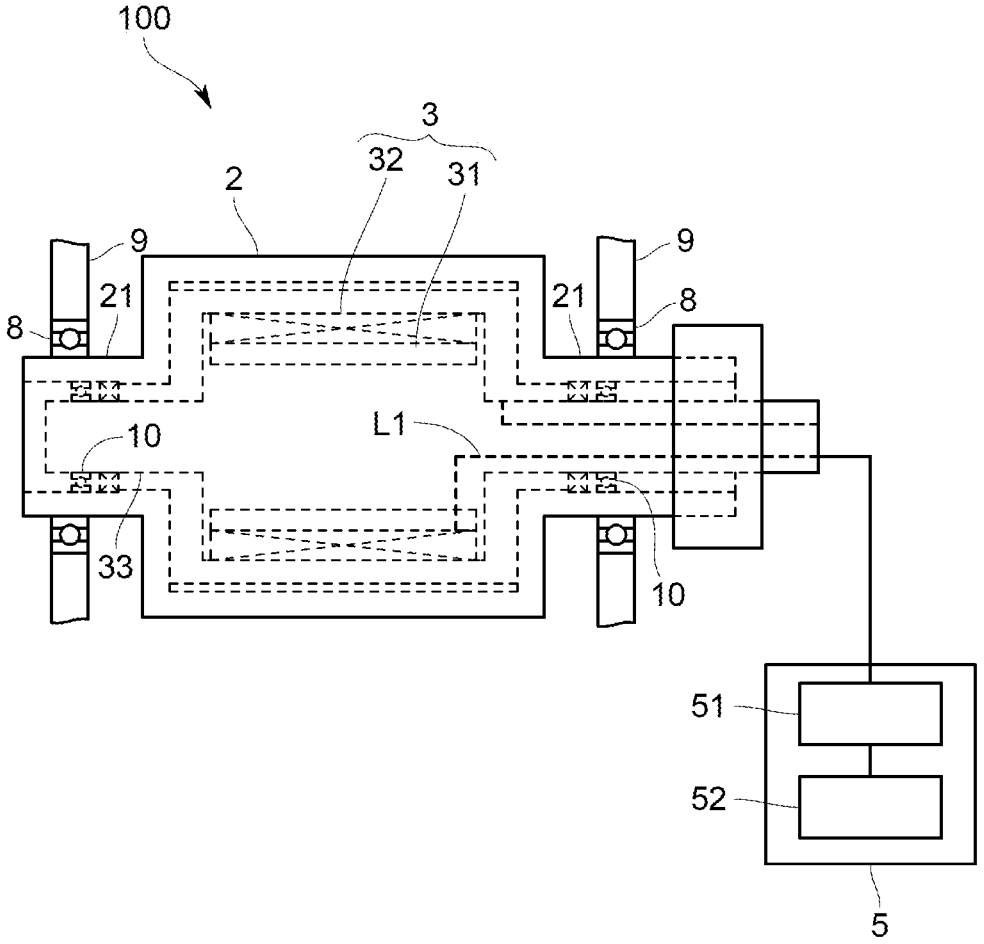
FIG. 1 is a diagram schematically illustrating the configuration of an induction heated roll apparatus according to the present embodiment.

Specifically, as illustrated in FIG. 1, this apparatus includes a rotatably supported and hollow cylindrical roll main body 2, and an induction heating mechanism 3 provided inside the roll main body 2.

Figure 2:
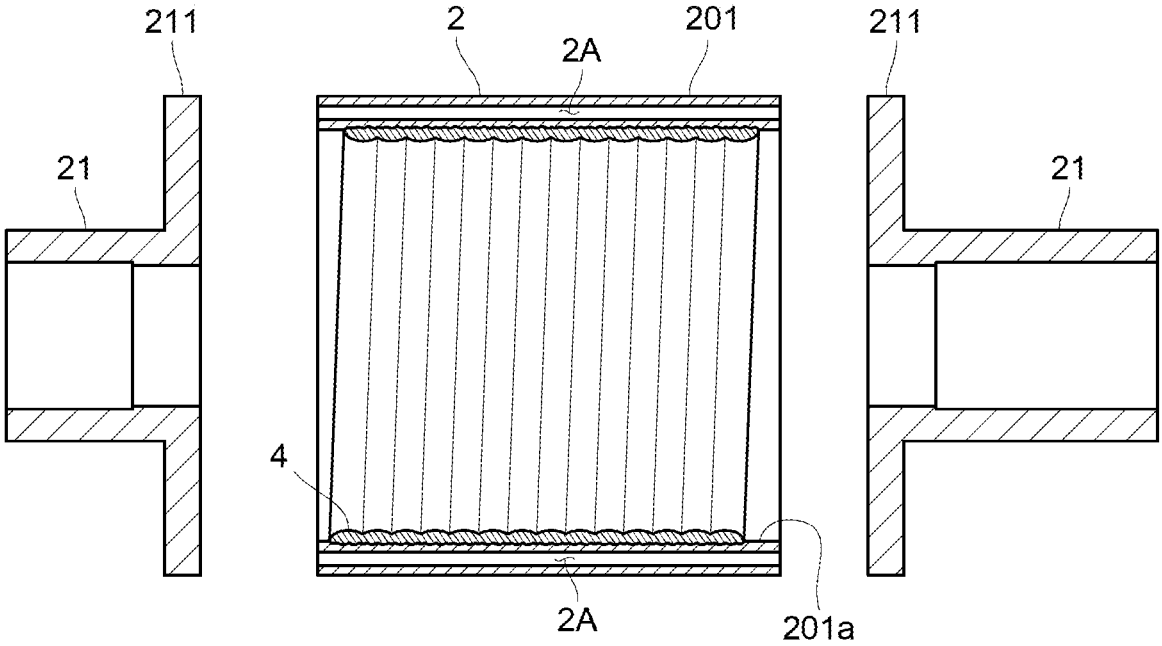
FIG. 2 is a cross-sectional view schematically illustrating a formation pattern of a secondary conductor according to the same embodiment.

At both end parts of the roll main body 2, hollow drive shafts 21 are provided, and the drive shafts 21 are rotatably supported by a machine base 9 via bearings 8 such as rolling bearings. In addition, the drive shafts 21 respectively have flanges 211 connected to the axial direction end surfaces of the roll main body 2 (see FIG. 2). The roll main body 2 including the drive shafts 21 is formed of a magnetic material such as carbon steel. Further, the roll main body 2 is configured to be rotated by a drive force externally given by a rotary drive mechanism (not illustrated) such as a motor. Also, in a side circumferential wall 201 as a thick wall part of the roll main body 2 in the present embodiment, jacket chambers 2A in which a vapor-liquid two-phase heating medium is enclosed under reduced pressure are formed. In the side circumferential wall 201, the multiple jacket chambers 2A extend in a longer direction (in a rotation axis direction) and are formed at regular intervals in a circumferential direction.

The induction heating mechanism 3 includes a cylindrical iron core 31 formed in a cylindrical shape and an induction coil 32 wound on the outer circumferential surface of the cylindrical iron core 31.

At both end parts of the cylindrical iron core 31, support shafts 33 are provided, and the support shafts 33 are respectively inserted into the drive shafts 21, and rotatably supported by the drive shafts 21 via bearings 10 such as rolling bearings. In doing so, the induction heating mechanism 3 is held in a resting state with respect to the machine base 9 (fixation side) inside the roll main body 2 being rotating.

Also, the induction coil 32 is connected with an external lead L1, and the external lead L1 is connected with a power supply device 5 for applying AC voltage having a commercial frequency (50 Hz or 60 Hz). The power supply device 5 includes a power supply part 51 that supplies AC power to the induction heating mechanism 3 and a temperature control part 52 that controls the power supply part 51 to control the temperature of the roll main body 2. The temperature control part 52 is a dedicated or general-purpose computer having a processor (e.g., a central processing unit (CPU)), internal memory, input/output interfaces, an analog-to-digital (AD) converter, and the like, and on the basis of a set temperature signal inputted by a user, controls the power supply part 51 to control the surface temperature of the roll main body 2 so that the surface temperature becomes equal to a set temperature. In addition, the temperature control part 52 may be configured to include an analog circuit.

In such an induction heating mechanism 3, when the AC voltage is applied to the induction coil 32, alternating magnetic flux is generated, and the alternating magnetic flux passes through the side circumferential wall 201 of the roll main body 2. This passage causes an induction current in the roll main body 2, and the induction current allows the roll main body 2 to generate Joule heat. Also, the jacket chambers 2A equalize the temperature distribution of the side circumferential wall 201 of the roll main body 2 in the rotation axis direction.

In addition, on the inner circumferential surface of the roll main body 2 in the present embodiment, a secondary conductor 4 is formed by build-up welding. The material (build-up material) of the secondary conductor 4 is aluminum bronze (an alloy of aluminum and copper). The aluminum bronze in the present embodiment is one containing 6% or more of aluminum.

Specifically, the secondary conductor 4 is formed on an inner circumferential surface 201*a* of the roll main body 2 over the entire circumferential direction, and also continuously formed along the rotation axis direction of the roll main body 2.

Here, the secondary conductor 4 is spirally formed, and continuously formed with mutually adjacent welded parts being in contact with each other. That is, the secondary conductor 4 is continuously formed over the entire winding width of the induction coil 32 in the rotation axis direction of the roll main body 2. In other words, the secondary conductor 4 is of a cylindrical shape that is formed along the rotation axis direction of the roll main body 2. Also, on the surface of the secondary conductor 4 made of aluminum bronze configured as described above, a protective oxide coating film is formed. The protective oxide coating film allows the secondary conductor 4 to have a rust-proofing function.

Figure 3:
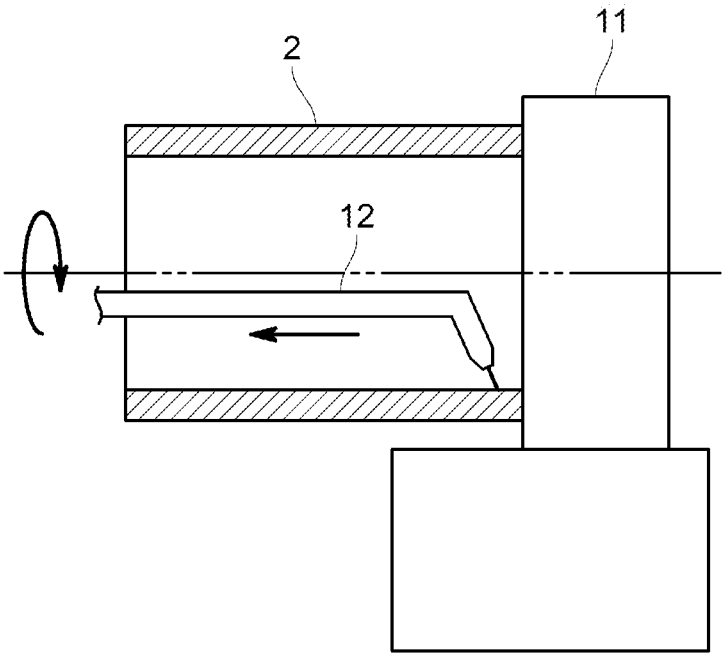
FIG. 3 is a schematic diagram illustrating a method for forming the secondary conductor according to the same embodiment.
Figure 5:
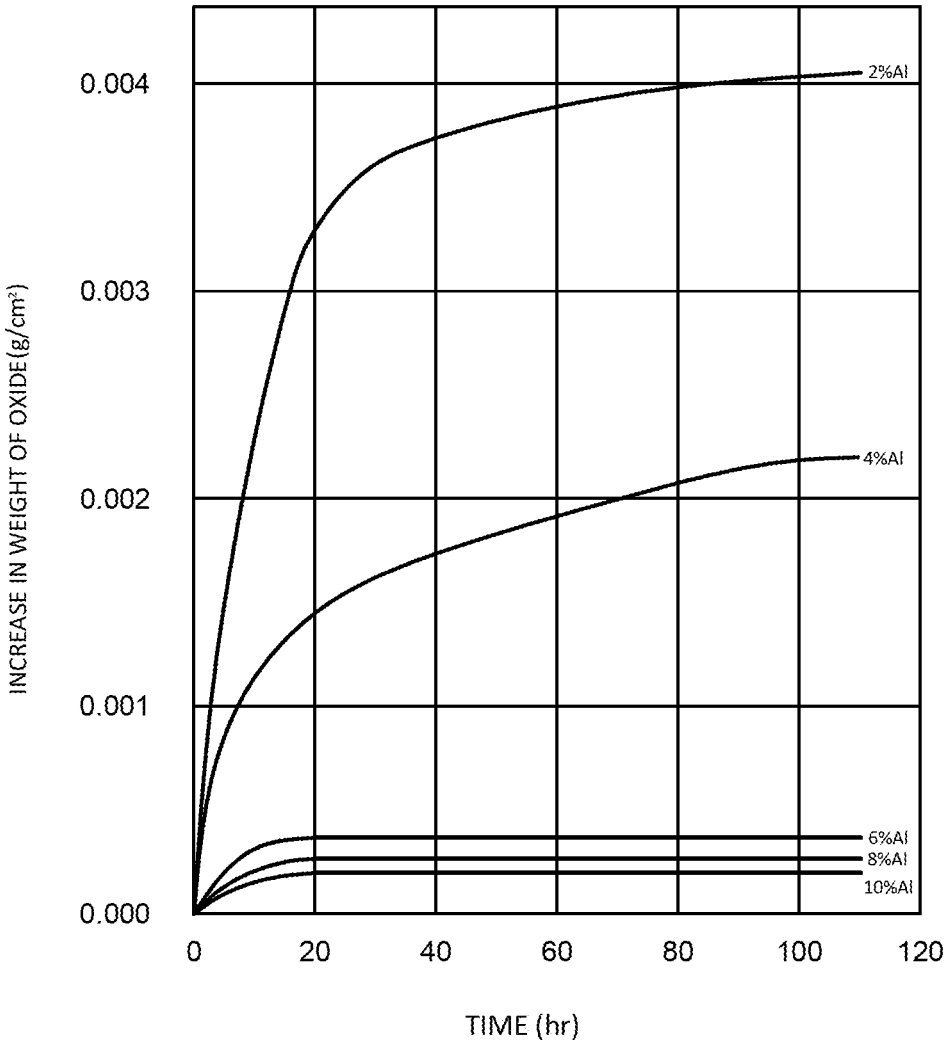
FIG. 5 is a diagram illustrating the relationship between an increase in the amount of oxide and elapsed time at each content percentage of aluminum in aluminum bronze.
Figure 6:
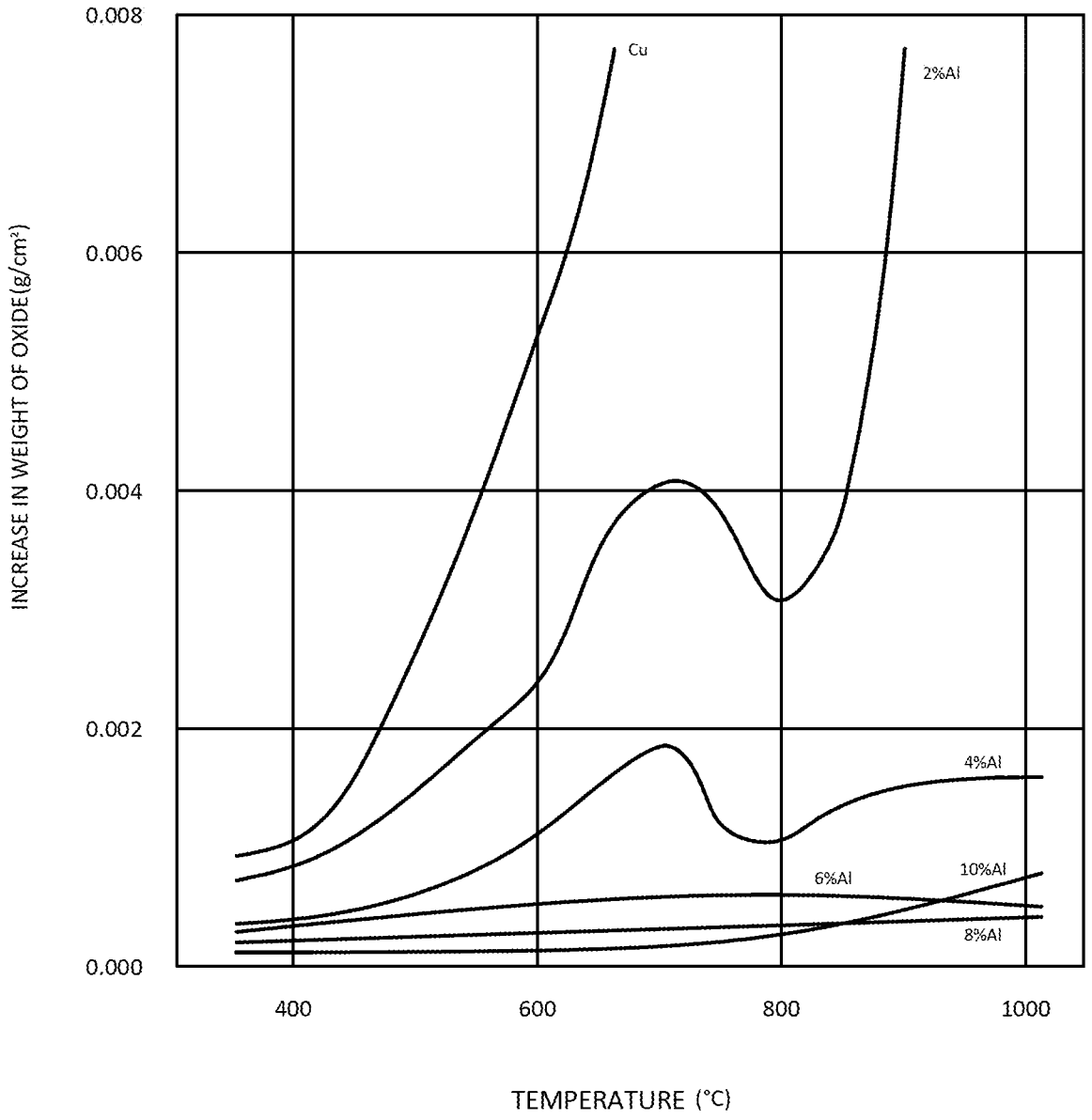
FIG. 6 is a diagram illustrating the relationship between an increase in the amount of oxide and temperature at each content percentage of aluminum in aluminum bronze.

Next, an example of build-up welding work for forming the secondary conductor 4 on the inner circumferential surface 201*a* of the roll main body 2 will be described with reference to FIG. 3.

The roll main body 2 is fitted to rotating equipment 11 for rotating the roll main body 2. By inserting a welding torch 12 into the roll main body 2 in this state, and while rotating the roll main body 2 by the rotating equipment 11, relatively moving the welding torch 12 in the rotation axis direction with respect to the roll main body 2, the spiral secondary conductor 4 is formed on the inner circumferential surface 201*a* of the roll main body 2. In this build-up welding, by appropriately setting pre-welding process conditions such as pre-heating of the roll main body 2, welding conditions such as the size and material of a welding wire, torch angle, torch position, voltage, current, rotation speed of the roll main body 2, and moving speed (drawing pitch) of the welding torch 12, and post-welding process conditions such as post-heating of the roll main body 2, various secondary conductors 4 can be formed.

Since on the surface of the secondary conductor 4 formed in this manner, the protective oxide film is formed, it is not necessary to perform a plating process for rust prevention, and therefore in the present embodiment, the plating process is not performed.

Also, since the jacket chambers 2A are formed in the side circumferential wall 201 of the roll main body 2, even when uneven heat generation occurs due to the uneven thickness of the aluminum bronze, the surface temperature of the roll main body 2 is adjusted to an equalized temperature by the temperature equalizing action of the jacket chambers 2A. For this reason, in the present embodiment, machining for equalizing the thickness of the secondary conductor 4 is not necessary. That is, a planarization process using removal machining for removing convex parts is not performed on the surface of the secondary conductor 4.

In the induction heated roll apparatus 100, a settable temperature by the temperature control part 52 is 500° C. or less. That is, the induction heated roll apparatus 100 is configured so that a user cannot set a temperature higher than 500° C. This is because, in the case of aluminum bronze containing 6% or more of aluminum, oxidation at 500° C. or less is extremely slight, but at temperatures higher than 500° C., an increase in weight due to oxidation becomes problematic.

Next, the results of a power factor test on the induction heated roll apparatus 100 will be described. The roll main body 2 used in this test has a diameter of 237 mm, a face length of 400 mm, and a thickness of 22 mm. Also, 30 jacket chambers 2A each having a diameter of 10 mm and a length of 380 mm are arranged in the center of the thickness 22 mm of the roll main body 2 at regular intervals. The width of the secondary conductor 4 in the axis direction is 380 mm. Electrical specifications are that an input is single-phase, 60 Hz, 220 V, and capacity with no secondary conductor is 5 kW.

Table 1 below lists power factors respectively in the cases of no build-up, copper build-up welding (build-up thickness of 0.5 mm, 1.0 mm, 1.5 mm) and 8%-aluminum-containing aluminum bronze build-up welding (build-up thickness of 1.5 mm, 3.0 mm). In addition, the build-up thickness (mm) indicates an average value in the axis direction.

TABLE 1

| Build-up metal type | Build-up thickness (mm) | Power factor (%) |
|---|---|---|
| None | 0 | 70.2 |
| Copper | 0.5 | 87.4 |
| Copper | 1.0 | 89.7 |
| Copper | 1.5 | 91.2 |
| Aluminum bronze containing 8% of aluminum | 1.5 | 83.5 |
| Aluminum bronze containing 8% of aluminum | 3.0 | 88.4 |

As can be seen from Table 1, by performing build-up welding of aluminum bronze to form the secondary conductor 4 and adjusting the build-up thickness of aluminum bronze containing 8% of aluminum to 1.5 mm or more, as compared with the case of no build-up welding, the power factor is improved, and achieves a target power factor (80%) or more. Also, it is conceivable that even in the case of aluminum bronze containing 6% of aluminum, the same effects can be obtained. Further, the build-up thickness leading to the target power factor (80%) or more can be calculated using an equivalent circuit diagram in the induction heating at a commercial frequency.

2. Effects of Present Embodiment

In the induction heated roll apparatus 100 configured as described above, since the secondary conductor 4 is formed by build-up welding, a tube body forming process and a tube body fitting process in the conventional case can be omitted. Also, a thin protective oxide coating film is formed on the surface of aluminum bronze, and therefore aluminum bronze is characterized by preventing oxidation at high temperatures and consequently resistant to corrosion. Also, by using aluminum bronze for the secondary conductor 4, a rust-proofing process such as a plating process can be omitted. As a result, the number of working processes necessary to provide the secondary conductor 4 on the inner circumferential surface 201*a* of the roll main body 2 can be reduced. Further, build-up welding is only required, and therefore work to fit the secondary conductor 4 on the inner circumferential surface of the roll main body 2 can be facilitated. Still further, since the secondary conductor 4 is formed by build-up welding, the roll main body 2 and the secondary conductor 4 are integrated and therefore also applicable to high speed rotation, and there is no loosening due to the difference in thermal expansion coefficient between the roll main body 2 and the secondary conductor 4, thus making it possible to also suppress a reduction in thermal conductivity between the roll main body 2 and the secondary conductor 4.

3. Variations of Present Invention

Note that the present invention is not limited to the above-described embodiment.

The material of the secondary conductor in the above-described embodiment may be copper or copper alloy. The copper alloy may be, for example, a non-magnetic copper alloy having high corrosion resistance, and it is conceivable to use aluminum bronze (an alloy of aluminum and copper), white copper (cupronickel, an alloy of copper and nickel), German silver (nickel silver; an alloy of copper, zinc, and nickel), red copper (an alloy of copper and gold), gunmetal (an alloy of copper and tin), or a combination thereof. Also, the surface of the secondary conductor 4 is subjected to a rust-proofing process. As the rust-proofing process, for example, a plating process such as nickel plating, an evaporation process such as aluminum evaporation or the like is conceivable. The rust-proofing process is performed after the secondary conductor 4 has been formed in the same manner as that in the above-described embodiment.

Also, as in the above-described embodiment, since the jacket chambers 2A are formed in the side circumferential wall 201 of the roll main body 2, even when uneven heat generation occurs due to the uneven thickness of the copper or copper alloy, the surface temperature of the roll main body 2 is adjusted to an equalized temperature by the temperature equalizing action of the jacket chambers 2A. For this reason, in the present embodiment, machining for equalizing the thickness of the secondary conductor 4 is not necessary. That is, a planarization process using removal machining for removing convex parts is not performed on the surface of the secondary conductor 4.

Next, the results of a power factor test on the induction heated roll apparatus 100 will be described. The roll main body 2 used in this test has a diameter of 237 mm, a face length of 400 mm, and a thickness of 22 mm. Also, 30 jacket chambers 2A each having a diameter of 10 mm and a length of 380 mm are arranged in the center of the thickness 22 mm of the roll main body at regular intervals. The width of the secondary conductor 4 in the axis direction is 380 mm. The electrical specifications are that the input is single-phase, 60 Hz, 220 V, and capacity with no secondary conductor is 5 kW.

Table 2 below lists power factors respectively in the cases of no build-up, and copper build-up welding (build-up thickness of 0.5 mm, 1.0 mm, 1.5 mm). In addition, the build-up thickness (mm) indicates an average value in the axis direction.

TABLE 2

| Build-up metal type | Build-up thickness (mm) | Power factor (%) |
|---|---|---|
| None | 0 | 70.2 |
| Copper | 0.5 | 87.4 |
| Copper | 1.0 | 89.7 |
| Copper | 1.5 | 91.2 |

As can be seen from Table 2, by performing build-up welding of copper to form the secondary conductor 4, as compared with the case of no build-up welding, the power factor is improved, and achieves a target power factor (80%) or more. Also, the build-up thickness leading to the target power factor (80%) or more can be calculated using an equivalent circuit diagram in the induction heating at a commercial frequency.

In the induction heated roll apparatus 100, a settable temperature by the temperature control part 52 is 500° C. or less. That is, the induction heated roll apparatus 100 is configured so that a user cannot set a temperature higher than 500° C. The settable temperature is determined depending on the type of the rust-proofing process to be performed on the surface of the secondary conductor 4. For example, when the rust-proofing process is nickel plating, the settable temperature is 400° C. or less, and when the rust-proofing process is aluminum evaporation, the settable temperature is 500° C. or less.

Even in the induction heated roll apparatus 100 configured as described above, since the secondary conductor 4 is formed by build-up welding, the tube body forming process and the tube body fitting process in the conventional case can be omitted. As a result, the number of working processes necessary to provide the secondary conductor 4 on the inner circumferential surface 201*a* of the roll main body 2 can be reduced. Also, build-up welding is only required, and therefore work to fit the secondary conductor 4 on the inner circumferential surface 201*a* of the roll main body 2 can be facilitated. Further, since the secondary conductor 4 is formed by build-up welding, the roll main body 2 and the secondary conductor 4 are integrated and therefore also applicable to high speed rotation, and there is no loosening due to the difference in thermal expansion coefficient between the roll main body 2 and the secondary conductor 4, thus making it possible to also suppress a reduction in thermal conductivity between the roll main body 2 and the secondary conductor 4 as well.

Also, as long as within the thickness of the roll main body 2, the jacket chambers 2A in which a vapor-liquid two-phase heating medium is enclosed under reduced pressure are formed, even when uneven heat generation occurs due to the uneven thickness of copper or copper alloy, the surface temperature of the roll main body 2 is adjusted to an equalized temperature by the temperature equalizing action of the jacket chambers 2A. For this reason, machining for equalizing the thickness of the secondary conductor 4 is not necessary. That is, it is not necessary to perform a planarization process using removal machining on the surface of the secondary conductor 4. As a result, the number of working processes to be performed on the secondary conductor 4 can be reduced, and also since the secondary conductor 4 is not removed, unnecessary material can be eliminated.

The secondary conductor 4 may be one whose thickness is adjusted along the rotation axis direction of the roll main body 2. That is, the thickness of the secondary conductor 4 may be changed along the rotation axis direction of the roll main body 2. This configuration makes it possible to partially increase or decrease the calorific value of the roll main body 2.

Also, the secondary conductor in the above-described embodiment is formed using aluminum bronze, but may be formed using white copper, German silver, red copper, gunmetal, or a combination thereof. These are non-magnetic copper alloys having high corrosion resistance, and the same effects as aluminum bronze can be obtained.

Further, the secondary conductor is annularly formed on the inner circumferential surface of the roll main body. However, multiple secondary conductors may be continuously formed in the rotation axis direction of the roll main body.

Figure 7:
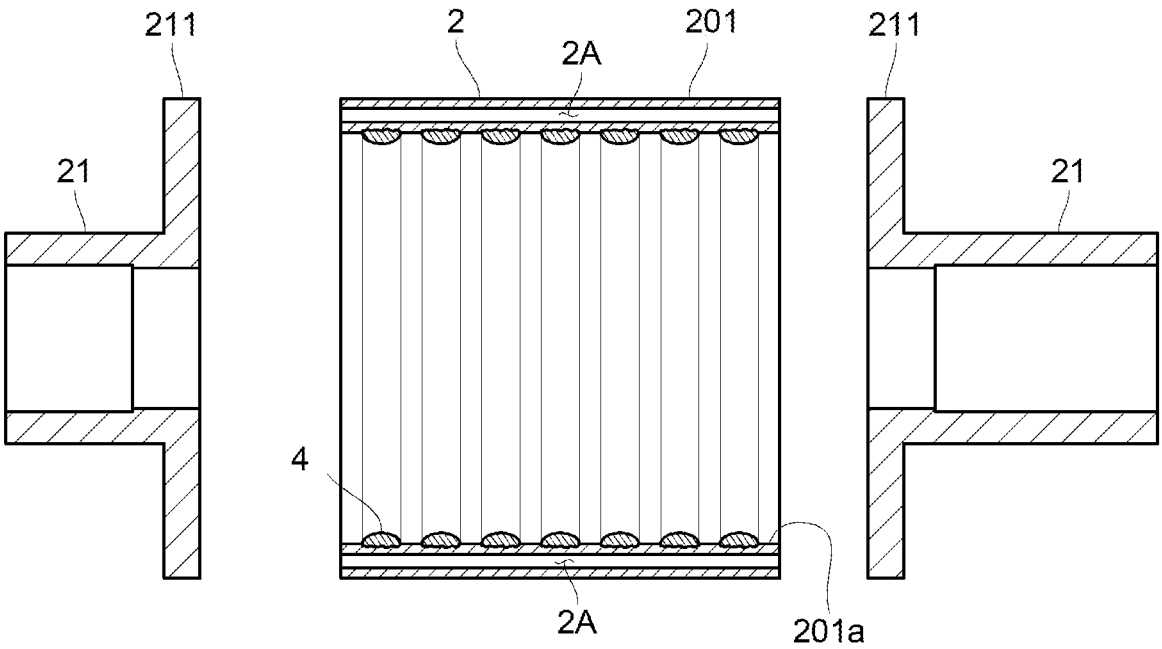
FIG. 7 is a cross-sectional view schematically illustrating a formation pattern of a secondary conductor according to a variation.
Figure 8:
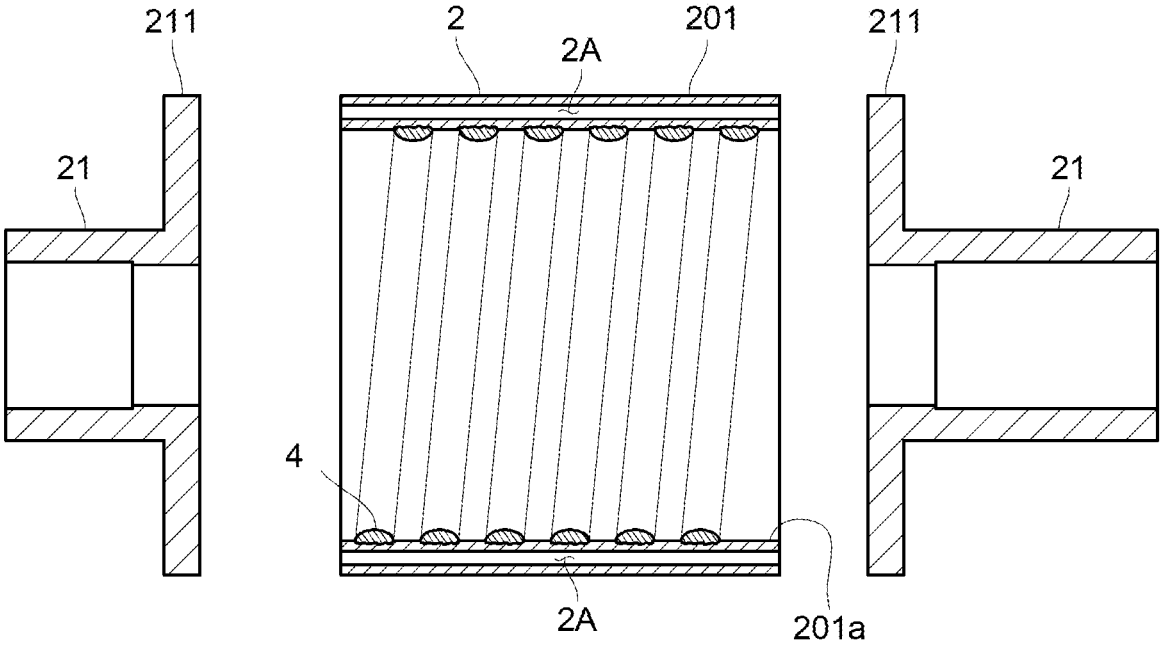
FIG. 8 is a cross-sectional view schematically illustrating a formation pattern of a secondary conductor according to another variation.

In addition, multiple secondary conductors may be intermittently formed in the rotation axis direction of the roll main body. For example, as illustrated in FIG. 7, secondary conductors 4 may be annularly formed at intervals on the inner circumferential surface 201*a* of the roll main body 2, or as illustrated in FIG. 8, may be spirally formed at intervals on the inner circumferential surface 201*a* of the roll main body 2. By forming secondary conductors 4 at intervals as described above, as compared with continuous formation work, formation work can be facilitated. Also, the secondary conductor 4 can be continuously formed by spiral formation as illustrated in FIG. 8.

Further, the electrical characteristics of the induction heated roll apparatus can be adjusted by the weight of the secondary conductor. For example, as long as the specifications of respective roll main bodies are the same, by equalizing the weights of secondary conductors to be worked, power factors and electrical capacities are also equalized, and work management is extremely easy. The following table lists electrical characteristics when the weights of secondary conductors are equalized, from which it turns out that as long as the weights of the secondary conductors are the same, the electrical characteristics are substantially the same. In addition, in the following table, the dimensions of a roll main body are a diameter of 300 mm, an inside diameter of 280 mm, and a face length of 189 mm, and the secondary conductors are made of pure copper, and the weights thereof are approximately 800 g. Although the following table provides a list when pure copper was used for the secondary conductors, the same holds true for the use of aluminum bronze.

TABLE 3

| Secondary conductor shape | Voltage (V) | Current (A) | Capacity (kW) | Power factor (%) |
|---|---|---|---|---|
| None | 418.0 | 74.5 | 14.1 | 45.2 |
| Annular | 419.7 | 86.7 | 21.7 | 59.6 |
| Spiral | 420.3 | 87.3 | 22.3 | 60.7 |
| Entire surface | 419.5 | 86.8 | 22.1 | 60.8 |

Besides, it goes without saying that the present invention is not limited to the above-described embodiment, but can be variously modified without departing from the scope thereof.

LIST OF REFERENCE CHARACTERS

100: Induction heated roll apparatus
2: Roll main body
201*a*: Inner circumferential surface
3: Induction heating mechanism
32: Induction coil
4: Secondary conductor

The invention claimed is:

1. An induction heated roll apparatus comprising:

a roll main body that is rotatably supported; and an induction heating mechanism that is provided inside the roll main body and has an induction coil for allowing the roll main body to inductively generate heat, and allowing the roll main body to inductively generate heat by applying alternating current (AC) voltage having a commercial frequency to the induction coil, wherein on an inner circumferential surface of the roll main body, a secondary conductor is formed by build-up welding, the secondary conductor is made of copper or copper alloy, a surface of the secondary conductor is not subjected to a planarization process using removal machining, and within a thickness of the roll main body, a jacket chamber in which a vapor-liquid two-phase heating medium enclosed via decompression sealing is formed, so as to adjust an uneven surface temperature of the roll main body caused by the secondary conductor;

wherein the secondary conductor is one of a cylindrical shape that is continuously formed from a first end part to a second end part of the roll main body in an axis direction;

wherein the surface of the secondary conductor is subjected to a rust-proofing process;

wherein an electrical characteristic of the induction heated roll apparatus is adjusted by a weight of the secondary conductor.

2. The induction heated roll apparatus according to claim 1, wherein a thickness of the secondary conductor changes along an axis direction of the roll main body.

3. The induction heated roll apparatus according to claim 1, wherein the secondary conductor is annularly formed, spaced at intervals on the inner circumferential surface of the roll main body.

4. The induction heated roll apparatus according to claim 1, wherein the secondary conductor is spirally formed, spaced at intervals on the inner circumferential surface of the roll main body.

* * * * *